US005755069A

United States Patent [19]

Sullivan

[11] Patent Number: 5,755,069

[45] Date of Patent: May 26, 1998

[54] LOUVER ASSEMBLY AND METHOD FOR INSTALLING A LOUVER ASSEMBLY

[75] Inventor: David Sullivan, Long Island City, N.Y.

[73] Assignee: Specialty Metal Fabricators, Inc., Long Island City, N.Y.

[21] Appl. No.: 810,583

[22] Filed: Mar. 4, 1997

[51] Int. Cl.[6] ..... E06B 7/08

[52] U.S. Cl. ..... 52/473; 52/220.8; 52/656.2; 52/656.8; 52/745.16; 454/277

[58] Field of Search ..... 52/473, 220.8, 52/656.2, 656.7, 656.8, 745.16; 454/271, 277, 281, 309

[56] References Cited

U.S. PATENT DOCUMENTS

| | | | |
|---|---|---|---|
| Re. 30,204 | 2/1980 | Root . | |
| 291,428 | 1/1884 | Trotter . | |
| 1,524,145 | 1/1925 | Mitchell et al. . | |
| 2,019,867 | 11/1935 | Nelson . | |
| 2,214,750 | 9/1940 | Myers . | |
| 2,291,383 | 7/1942 | Espenschied . | |
| 2,575,499 | 11/1951 | Manow . | |
| 2,881,854 | 4/1959 | Uehre, Jr. . | |
| 2,981,367 | 4/1961 | Sprouse . | |
| 2,995,787 | 8/1961 | Sarria . | |
| 3,046,719 | 7/1962 | Tropiano . | |
| 3,120,036 | 2/1964 | Minds, Jr. . | |
| 3,153,819 | 10/1964 | Bond . | |
| 3,181,661 | 5/1965 | Cochran | 52/473 |
| 3,202,082 | 8/1965 | Viehmann . | |
| 3,243,942 | 4/1966 | Burke . | |
| 3,250,063 | 5/1966 | Andrews . | |
| 3,252,580 | 5/1966 | Getzin . | |
| 3,525,378 | 8/1970 | Root . | |
| 3,546,359 | 12/1970 | Ciccarelli . | |
| 3,566,916 | 3/1971 | Root . | |
| 3,580,321 | 5/1971 | Root . | |
| 3,606,245 | 9/1971 | Reichow et al. . | |
| 3,628,442 | 12/1971 | Nijhuis . | |
| 3,677,517 | 7/1972 | Root et al. . | |
| 3,718,081 | 2/1973 | Root . | |
| 3,732,800 | 5/1973 | Goettel | 454/281 X |
| 3,738,254 | 6/1973 | Root . | |
| 3,782,050 | 1/1974 | Dowdell et al. . | |
| 3,817,485 | 6/1974 | Root . | |
| 3,858,355 | 1/1975 | Root . | |
| 3,907,020 | 9/1975 | Root . | |
| 3,941,179 | 3/1976 | Root . | |
| 3,943,679 | 3/1976 | Dissinger | 52/473 |

(List continued on next page.)

*Primary Examiner*—Christopher Kent
*Attorney, Agent, or Firm*—Kenyon & Kenyon

[57] ABSTRACT

A louver assembly and a method for installing the louver assembly into an opening in a wall of a structure are provided wherein the louver includes a frame which and a separate louver section which may be mounted within the frame after the frame has been mounted in the opening in the wall. The frame defines a central channel which extends from an interior opening to an exterior opening. The frame includes a frame flange extending from an exterior edge of the central channel so that, when the frame is in a desired position within the hole in the wall, the frame flange extends around the entire perimeter of the hole to seal the perimeter of the hole. The louver section is selectively mountable within the central channel so that it is prevented from passing through the exterior opening. When the louver section is in a desired position within the central channel, the frame is sealed so that air is prevented from passing between the frame and an outer surface of the louver section.

20 Claims, 2 Drawing Sheets

U.S. PATENT DOCUMENTS 3,968,738 7/1976 Matzke .
3,996,952 12/1976 Root .
4,018,024 4/1977 Stelzer .
4,140,151 2/1979 van Becelare .
4,184,509 1/1980 Kasper .
4,274,330 6/1981 Witten et al. .
4,334,899 6/1982 McConnell .
4,366,830 1/1983 van Becelare .
4,432,272 2/1984 van Becelaere .
4,446,667 5/1984 Hertel .
4,481,734 11/1984 Vaida .
4,515,068 5/1985 van Becelaere .
4,524,678 6/1985 Klebanoff .
4,738,191 4/1988 Porter ..... 454/309
4,813,183 3/1989 Jordal .
4,958,555 9/1990 Lentz et al. .
4,989,502 2/1991 Ospelt .
5,029,628 7/1991 Lemay .
5,048,253 9/1991 Olsen .
5,060,442 10/1991 Chubb .
5,203,394 4/1993 Hailey .
5,216,837 6/1993 Cleaver et al. .
5,255,486 10/1993 Wang .
5,267,414 12/1993 Vaida .
5,353,565 10/1994 Tanikawa .

LOUVER ASSEMBLY AND METHOD FOR INSTALLING A LOUVER ASSEMBLY

FIELD OF THE INVENTION

The present invention relates a louver assembly and a method for installing a louver assembly in an external section of a wall.

BACKGROUND OF THE INVENTION

Conventional louver assemblies are generally constructed as single piece assemblies including a peripheral flange which engages the perimeter of a wall opening. Many such conventional louver assemblies are relatively heavy and bulky, making installation difficult, dangerous or even impossible. This is especially the case for louver assemblies weighing over one hundred pounds (for example, 4×8foot louvers): During installation, such conventional louvers have to be maneuvered out of the wall opening and often must be supported by the installer who must reach out through the opening to align the louver and draw it back into the opening. This process is difficult and dangerous, especially when the wind is blowing and/or when air is moving in or out of the wall opening. After such a louver has been installed, the installer must seal the opening to prevent water and cold air from entering the building. On any floor above the first floor of the building, it is difficult (or impossible) to reach the louver and properly seal the louver flange to the building. This is due to the fact that the louver blades prevent the installer from reaching through the opening to access the exterior of the louver or the exterior building surface.

Another known louver assembly includes no outer flange and may, therefore, be installed without being passed to the outside of the building and then drawn back into the wall opening. Such a louver may slide directly into position within the wall opening from the inside of the building. However, the joint between the outside of such a flangeless louver and the wall opening often cannot be properly sealed. Thus, the connection is not air or water tight. The lack of a flange also makes it more difficult to properly align the louver within the wall opening.

Furthermore, connection between such known louvers and duct work is cumbersome. The conventional louver designs provide a one inch wide flat surface around a back exterior of the louver. The ducts are often provided with a one inch flange either on an inside or outside surface thereof, which is then attached to the louver flange using screws. With such an arrangement, achieving a permanent air tight seal is difficult and time consuming.

SUMMARY OF THE INVENTION

The present invention is directed to a louver assembly for installation into a hole in a wall comprising a frame defining a central channel extending from an interior opening to an exterior opening. The frame includes a frame flange extending from an exterior edge of the central channel so that, when the frame is in a desired position within the hole in the wall, the frame flange extends around the entire perimeter of the hole to seal the perimeter of the hole. A louver section is selectively mountable within the central channel so that it is prevented from passing through the exterior opening and when the louver section is in a desired position within the central channel, the frame is sealed so that air is prevented from passing between the frame and an outer surface of the louver section.

The present invention is also directed to a method for installing a louver assembly into a hole in a wall of a structure, the method comprising the steps of passing a frame through the hole in the wall wherein the frame defines a central channel extending from an interior opening to an exterior opening and includes a frame flange extending from an exterior edge of the exterior opening in a plane substantially parallel to the wall. Thereafter the frame flange is aligned with the hole and the frame is drawn into a desired position within the hole so that the frame flange extends over a portion of the wall adjacent to the hole around the entire perimeter of the hole. Thereafter the frame is coupled to the wall and a louver section is inserted into the central channel via the interior opening of the frame and the louver section is mounted within the central channel so that the louver section is prevented from passing through the exterior opening of the frame.

DETAILED DESCRIPTION

Figure 1:
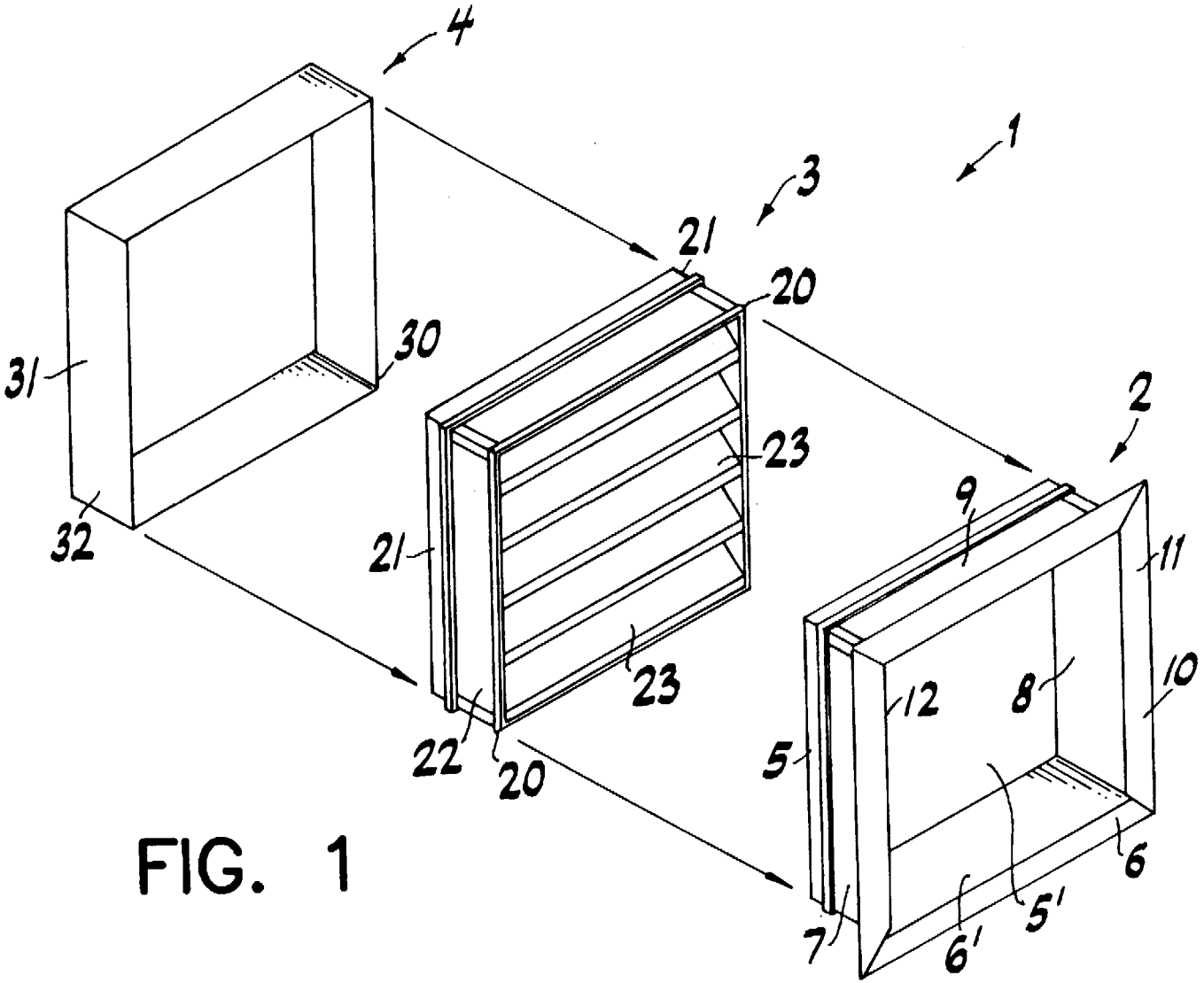
FIG. 1 shows a louver assembly according to the present invention.

FIG. 1 shows a detailed illustration of a louver assembly 1 according to the present invention. The louver assembly 1 includes a louver frame 2 and an inner louver section 3. The louver assembly 1 may also include an optional louver sleeve 4. The louver assembly 1 is preferably constructed from a metal alloy, such as extruded aluminum. However, louver assemblies according to the present invention may also be constructed from other materials, such as plastics, etc. The louver frame 2 is, preferably, rectangular or square, however other shapes of the louver frame 2 maybe also be employed depending upon the shape of the opening into which the louver is to be installed. Such an extruded aluminum louver frame having dimensions of 4 feet by 8 feet will weigh approximately 17 pounds. The louver frame 2 has internal frame sides 5 forming a first frame open end 5', external frame sides 6 forming a second frame open end 6' and a central frame portion 7. The central frame portion 7 extends from the first frame open end 5' to the second frame open end 6'. The central frame portion 7 has inner walls 8 and outer walls 9. The inner walls 8 allow the inner louver section 3 to slidably engage the louver frame 2 as it is pushed through the first frame open end 5'. The outer walls 9 preferably interface with the sides of a hole in an exterior wall structure into which the louver assembly 1 is to be installed.

Figure 2:
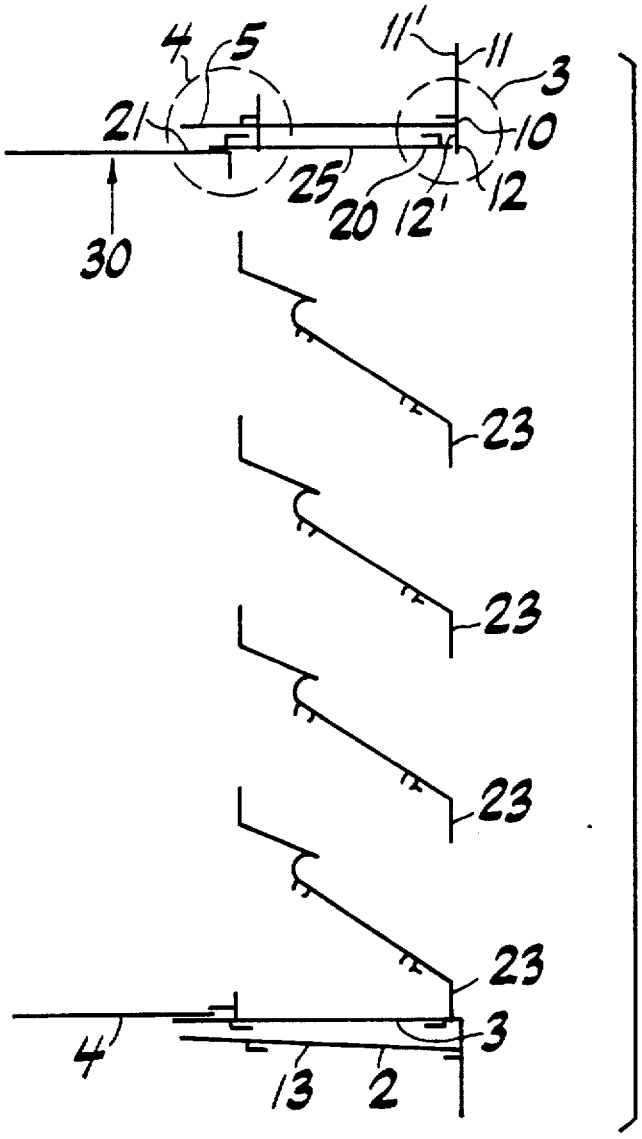
FIG. 2 shows a side view of an assembled louver assembly according to the present invention.
Figure 3:
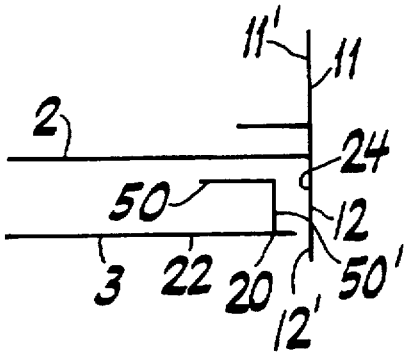
FIG. 3 shows an enlargement of a contact area between a louver frame and an inner louver section of the louver assembly according to the present invention.

An outer flange 10 is positioned substantially around the contour of the center frame portion 7 at the external frame sides 6. The outer flange 10 includes an external flange member 11 and also may preferably include an internal flange member 12. The external flange member 11 preferably extends away from a center of the second frame open end 6' in a plane substantially orthogonal to the internal walls 8 of the central frame portion 7. Of course, the external flange member 11 may be adjusted so that it aligns with the portions of the outer wall adjacent to the opening, while the inner walls 8 are preferably aligned substantially with the sides of the opening. The external flange member 11 has an external flange member coupling side 11' (shown in FIGS. 2 and 3) for interfacing with (or abutting against) an exterior portion of the exterior wall structure immediately adjacent to the hole which accommodates the louver assembly 1. The outer flange 10 may either be attached to the central frame portion 7 as a separate element, or may be formed integrally with the central frame portion 7. The optional internal flange member 12 extends toward a center of the second frame open end 6' in a plane substantially orthogonal to the internal walls 8 of the central frame portion 7. As shown in FIGS. 2 and 3, the inner flange member 12 includes an internal flange member coupling side 12' which contacts the inner louver section 3 to prevent it from sliding out through the louver frame 2. Of course, those skilled in the art will understand that other structures may be employed to prevent the inner louver section 3 from passing through the second frame open end 6'. For example, a flange may be extended from an exterior perimeter of the inner louver section 3 to contact an interior perimeter of the louver frame 2. Alternatively, the interior space within the louver frame 2 and the inner louver section 3 may be sized so that a friction fit is obtained which maintains the inner louver section 3 in position within the louver frame 2. The internal flange member 12 may, for example, extend approximately 0.5 inches toward the center of the second frame open end 6'. Of course, those skilled in the art will understand that internal flange member of various extensions are conceivable.

As shown in FIGS. 1–3, the inner louver section 3 includes a slat holding portion 22, an outer section edge 20 for abutting the internal flange member coupling side 12' and an inner section edge 21 for coupling to the louver sleeve 4. The inner louver section 3 includes a plurality of horizontally-spaced slats 23, which are enclosed in the slat holding portion 22. These slats 23 allow air to flow from the outside of the louver assembly 1 to the inside, and vice versa. The inner louver section 3 may also include an outer extrusion 50 having, for example, 0.1×0.215 inch dimensions. The outer extrusion 50 is positioned externally on the outer section edge 20 for cooperating with the internal flange member 12' of the louver frame 2. The inner louver section 3 preferably has a shape substantially similar to that of the louver frame 2. The cross-sectional area of the inner louver section 3 (at least at the outer section edge 20) is slightly smaller than the cross-sectional area of the louver frame 2 at the internal frame sides 5.

A user first installs the louver frame 2 into the opening so that the flange 10 extends around the entire perimeter of the opening. Those skilled in the art will recognize that, as the perimeter of the flange 10 is larger than that of the opening, the louver frame 2 must be passed through the opening at an angle (preferably along the diagonal for square or rectangular openings), rotated into alignment with the opening, and drawn back into the opening, sealed and secured to the wall of the structure. Of course, because the center of the louver frame 2 is open, the installer can reach through the opening to seal around the entire perimeter of the opening to secure the louver frame 2 to the wall. Then, the inner louver section 3 is inserted into the louver frame 2 through the first frame open end 5' of the louver frame 2. The inner louver section 3 is pushed through the central frame portion 7 of the louver frame 2 until the outer section edge 20 of the inner louver section 3 reaches the external frame sides 6 of the louver frame 2. The slidable movement of the inner louver section 3 of this embodiment is stopped at the second frame open end 6' of the louver frame 2 when the internal flange member coupling side 12' of the internal flange member 12 contacts the outer section edge 20 of the inner louver section 3 at a contacting louver portion 24, as shown in FIG. 3. It is also conceivable that another flange may be situated at the inner section edge 21 of the inner louver section 3, and therefore, when the louver section 3 is inserted into the louver frame 2, this flange would abut the internal frame sides 5 of the louver frame 2 (instead of, or in addition to, abutting the internal flange member 12 to the outer section edge 20 of the inner louver section 3). Furthermore, the inner louver section 3 can also be frictionally coupled to the louver frame 2 (instead of, or in addition to, using the flange portion 10 of the louver frame 2 and/or the flange of the louver section for contacting the louver frame 2 and the inner louver section 3, as described above).

In FIG. 3, which illustrates an enlargement of the contact area between the louver frame 2 and the inner louver section 3, it is also shown that a bead of caulking compound may be applied between the outer extrusion 50 of the inner louver section 3 and the louver frame 2 at the contacting louver portion 24 to seal the louver frame 2 to the inner louver section 3 to prevent air leaks. Other methods of sealing the connection between the louver frame 2 and the inner louver section 3 at the contacting louver portion 24 may also be employed. In addition, the louver frame 2 may be sealed to the inner louver section 3 at a middle louver portion 25 of the inner louver section 3 and a middle frame portion 13 of the louver frame 2, as shown in FIG. 2.

The louver sleeve 4 includes a duct portion 32 having a sleeve connection edge 30 for inserting into the inner louver section 3 at the inner section edge 21. The duct portion 32 also includes a duct connection edge 31 for connecting to an internal duct. The shape of the duct portion 32 substantially corresponds to the shape of the inner louver section 3, except that the cross-sectional area of the inner louver section 3 (at least at the inner section edge 21) is slightly larger than the cross-sectional area of the louver sleeve 4 at the sleeve connection edge 30. The louver sleeve 4 is inserted into the inner louver section 3 at the inner section edge 21, sliding through the inner section edge 21, and contacting a sleeve contacting portion 26 of the inner louver section 3, as shown in FIG. 4.

Figure 4:
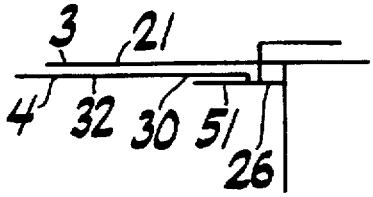
FIG. 4 shows an enlargement of a contact area between the inner louver section and a louver sleeve of the louver assembly according to the present invention.

In FIG. 4, which illustrates an enlargement of a contact area between the inner louver section 3 and the louver sleeve 4, it is also shown that the inner louver section 3 may include a sleeve catching member 5 internally positioned at the inner section edge 21 for catching the sleeve connection edge 30 of the louver sleeve 4. Caulking compound may also be used between the inner louver section 3 and the louver sleeve 4 at the contacting duct portion 32 (and within the sleeve catching member 51) to seal the contact between the inner louver section 3 and the louver sleeve 4, so that air leaks are further prevented. Those skilled in the art will understand that other methods of sealing the connection between the inner louver section 3 and the louver sleeve 4 may also be employed.

During installation of the louver assembly 1, a hole within the exterior wall structure having a shape substantially corresponding to the shape of the louver frame 2 is provided. A bead of caulking compound (or other sealing means) to the external flange member coupling side 11' and then an additional bead of caulking may also be applied to an exterior surface 50' of the outer extrusion 50. It will also be appreciated by those skilled in the art that the sealing means may also be applied between the walls around the perimeter of the hole and the central frame portion 7 of the louver frame 2. The hole extends from an internal location in the building (or the wall structure) to the outside of the building (or the wall structure). To insert the louver frame 2, a user rotates the louver frame 2 to a diagonal position relative to the hole and passes the louver frame 2 through the hole in the building. The user then rotates the louver frame 2, so that the louver frame 2 is aligned with the hole in the building, and pulls the louver frame 2 back into the hole until the external flange member 11 contacts the wall area around the perimeter of the hole.

Of course, when convenient, the louver frame 2 may be installed externally. However, the internal installation of the louver frame 2 as described above is often preferable, since there is no need to handle the louver frame 2 outside of the building. The user may then internally apply screws through the central frame portion 7 to couple the louver frame 2 to the wall of the building.

After the louver frame 2 has been installed in the hole, the inner louver section 3 (via the outer section edge 20) is inserted into the first frame open end 5' of the louver frame 2 from inside of the building. The inner louver section 3 is pushed through the central frame portion 7 of the louver frame 2 until the outer section edge 20 of the inner louver section 3 contacts the internal flange member 12 of the louver frame 2. Before sliding the inner louver section 3 into the louver frame 2, caulking compound may be applied at a contacting louver portion 24, as shown in FIG. 3. Thus, the inner louver section 3 is snugly coupled to the louver frame 2. In addition, the user may use screws to further secure the inner louver section 3 to the louver frame 2. The screws can be applied internally through the inner section edge 21 and through the first frame open end 5'. Thereafter, the louver sleeve 4 may be inserted into the inner louver section 3 at the inner section edge 21. The louver sleeve 4 is pushed through the inner section edge 21 until it contacts the sleeve contacting portion 26 of the inner louver section 3. A bead of caulking compound, which has been previously applied to the space between the exterior surface 51' and the inner section edge 21, snugly and airtightly connects the louver sleeve 4 to the inner louver section 3. The louver sleeve 4 may then be further secured to inner louver section 3 using screws penetrating the duct portion 32 to couple to the inner section edge 21 of the louver section 3.

The above described embodiments are illustrative only and are not intended to limit the scope of the present invention. Those skilled in the art will understand that there are many modifications to the described embodiments which are within the teaching of the present invention, which is to be limited only by the claims appended hereto.

What is claimed is:

1. A louver assembly for installation into a hole in a wall of a structure, the louver assembly comprising:

a frame defining a central channel extending from an interior opening to an exterior opening, the frame including a frame flange extending from an exterior edge of the central channel so that, when the frame is in a desired position within the hole in the wall, the frame flange extends around the entire perimeter of the hole to seal the perimeter of the hole; and a louver section selectively mountable within the central channel via the interior opening, wherein, when mounted in the channel, the louver section is prevented from passing through the exterior opening, and wherein, when the louver section is in a desired position within the central channel, the frame is sealed so that air is prevented from passing between the frame and an outer surface of the louver section.

2. The louver assembly according to claim 1, wherein the frame flange includes an inner flange member extending toward a center of the exterior opening and wherein, when the louver section is in the desired position within the central channel, the flange member abuts an exterior edge of the louver section.

3. The louver assembly according to claim 2, wherein the inner flange member extends approximately 0.5 inches toward a center of the exterior opening.

4. The louver assembly according to claim 1, wherein the louver section includes a louver section flange extending from an interior edge of the louver section in a plane substantially parallel to the frame flange so that, when the louver section is in a desired position within the central channel, the louver section flange abuts an interior edge of the frame at the interior opening.

5. The louver assembly according to claim 1, wherein, when the louver section is in a desired position within the central channel, the louver section is frictionally coupled to the frame so that the louver section is prevented from passing through the exterior opening.

6. The louver assembly according to claim 1, wherein the louver section includes a plurality of slats spaced apart from one another and extending across the louver section so that, when the louver section is in the desired position within the central channel, air may flow through the louver section between the central channel and an exterior of the structure.

7. The louver assembly according to claim 1, wherein the louver section includes at least one protruding element positioned at an exterior edge thereof.

8. The louver assembly according to claim 1, further comprising a sleeve insertable into an interior edge of the louver section for connecting the louver assembly to an air duct.

9. The louver assembly according to claim 8, wherein the louver section includes a sleeve catching member positioned at the interior edge of the louver section for contacting a sleeve connecting edge of the sleeve.

10. A method for installing a louver assembly into a hole in a wall of a structure, the method comprising the steps of:

installing a frame in the hole in the wall, the frame defining a central channel extending from an interior opening to an exterior opening and including a frame flange extending from an exterior edge of the exterior opening in a plane substantially parallel to the wall;

so that the frame flange is aligned with the hole and extends over a portion of the wall adjacent to the hole around the entire perimeter of the hole; coupling the frame to the wall;

inserting a louver section into the central channel via the interior opening of the frame; and mounting the louver section within the central channel so that the louver section is prevented from passing through the exterior opening of the frame.

11. The method according to claim 10, wherein the frame includes an inner flange member extending toward a center of the exterior opening and abutting an external edge of the inner section.

12. The method according to claim 11, further comprising the step of:

applying a sealing compound at a first coupling location to sealingly attach the frame to the structure, wherein the first coupling location is located between the frame flange and the wall.

13. The method according to claim 12, wherein the step of coupling the frame to the wall further includes the step of inserting screws through the frame into the structure.

14. The method according to claim 10, wherein the step of mounting the louver section includes abutting a louver section flange against an interior edge of the frame at the interior opening.

15. The method according to claim 10, wherein the step of mounting the louver section includes the step of frictionally coupling the louver section to the frame.

16. The method according to claim 12, wherein the frame flange further includes an inner flange member extending toward a center of the exterior opening, the method further comprising the step of:

applying a sealing compound at a second coupling location to sealingly attach the louver section to the frame, wherein the second coupling location is located between the inner flange member and an exterior edge of the louver section.

17. The method according to claim 16, further comprising the step of:

inserting screws through the louver section into frame.

18. The method according to claim 10, further comprising the step of:

inserting a sleeve into an inner edge of the louver section for connecting the louver section to an air duct.

19. The method according to claim 18, wherein the louver section includes a sleeve catching member positioned at an interior edge of the louver section for receiving a sleeve connecting edge of the sleeve.

20. A louver assembly for installation into a hole in a wall of a structure, the louver assembly comprising:

an outer frame including at least one inner surface defining a central channel extending from an interior opening to an exterior opening, the outer frame including a frame flange extending from an exterior edge of the inner surface of the outer frame away from a center of the central channel so that, when the outer frame is in a desired position within the hole in the wall, the frame flange extends around the entire perimeter of the hole to seal the perimeter of the hole; and a louver section including a plurality of slats mounted within a louver section frame and extending across the louver section from a first side of the louver section to a second side thereof, the louver section being selectively mountable within the central channel via the interior opening, wherein, when mounted in the central channel, the louver section is prevented from passing through the exterior opening, and wherein, when the louver section is in a desired position within the central channel, the outer frame is sealed to the louver section frame so that air is prevented from passing between the inner surface of the outer frame and an outer surface of the louver section frame.

* * * * *